United States Patent [19]

McAllister

[11] Patent Number: 4,586,617

[45] Date of Patent: May 6, 1986

[54] CURTAIN ROD

[76] Inventor: Jack S. McAllister, Rte. 2, Box 336, Shiloh Rd., Belleville, Ill. 62221

[21] Appl. No.: 123,115

[22] Filed: Feb. 21, 1980

[51] Int. Cl.[4] ..... A47H 1/02

[52] U.S. Cl. ..... 211/105.2

[58] Field of Search ..... 211/105.2; 248/262, 248/263, 224.4, 285.1; 403/245, 246, 264

[56] References Cited

U.S. PATENT DOCUMENTS

| | | | |
|---|---|---|---|
| 1,488,256 | 3/1924 | Kirsch | 211/105.2 |
| 1,488,257 | 3/1924 | Kirsch | 248/262 |
| 1,531,645 | 3/1925 | Civis | 248/262 |
| 1,804,669 | 5/1931 | Boye | 211/105.2 |
| 1,969,913 | 8/1934 | Stapledon | 248/263 |
| 2,162,674 | 6/1939 | Kenney | 248/262 |
| 2,237,406 | 4/1941 | Boye | 211/105.2 |

*Primary Examiner*—Robert W. Gibson, Jr.

*Attorney, Agent, or Firm*—Polster, Polster and Lucchesi

[57] ABSTRACT

A return type curtain rod, for use with a hanger having a gusset plate and an upwardly projecting finger, has a web and upper and lower flanges projecting in facing relation from opposite long edges of the web, an isolated hanger finger-receiving hole in the upper of the flanges and an edge of the lower flange spaced from the free end of the web in a direction short of the free end edge and clear of obstruction between the lower flange edge and the free end edge a distance to accommodate the gusset plate, whereby the free edge of the web serves to support the rod against turning moment around the finger.

1 Claim, 6 Drawing Figures

CURTAIN ROD

BACKGROUND OF THE INVENTION

In installing return type curtain rods on hangers having gusset plates and upwardly projecting fingers, it is normally necessary to raise the main bar of the rod a substantial distance to a sharp angle with respect to the wall in order to permit the finger to enter a hole in the upper flange of the rod and the lower flange to clear the outer camming edge of the gusset plate.

In many contemporary installations, interior decorators would like to have the rod close to the ceiling line, but it is impossible to position the rod any closer than the distance required to turn up the main bar of the rod.

One of the objects of this invention is to provide a return type curtain rod that can be installed with only a fraction of an inch clearance between the ceiling and the top edge of the upwardly projecting finger of the hanger bracket. Other objects will become apparent to those skilled in the art in the light of the following description.

SUMMARY OF THE INVENTION

In accordance with this invention, generally stated, in a return type curtain rod for use with a hanger having a gusset plate and an upwardly projecting finger, the rod having a web and upper and lower flanges projecting in facing relation from opposite long edges of the web and an isolated hanger finger-receiving hole in the upper of the flanges, the free end edge on the web beyond the hanger-finger receiving hole extends generally perpendicularly to the upper flange and an edge of the lower flange is spaced from the free end edge of the web in a direction short of the free end edge and clear of obstruction between the lower flange edge and the free end edge a distance to accommodate the gusset plate, whereby the free edge of the web serves to support the rod against turning moment around the finger, and the rod can be mounted on the hanger by lifting it only high enough above the finger for the thickness of the flange to clear, and moving the end of the rod straight in until the hole in the rod is positioned directly above the upwardly projecting finger of the hanger bracket, and dropping it into position.

DESCRIPTION OF THE PREFERRED EMBODIMENT

Figure 1:
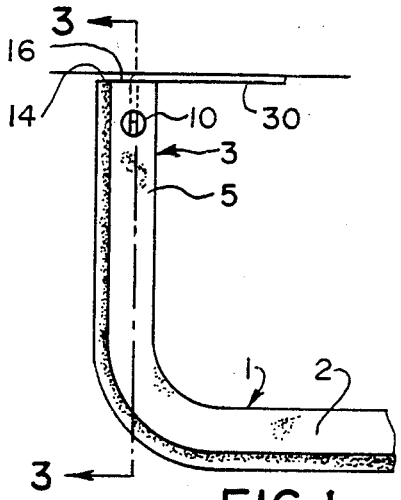
FIG. 1. PRIOR ART
FIG. 1 is a top plan fragmentary view of a conventional curtain rod of the return type.
Figure 2:
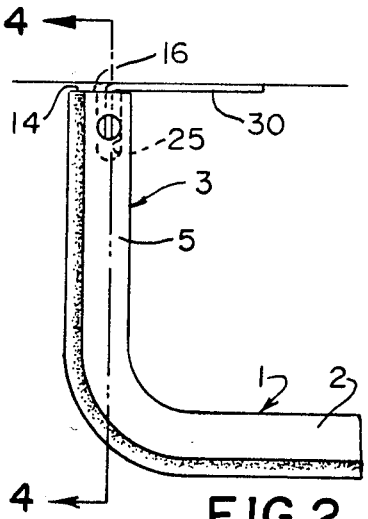
FIG. 2 is a top plan fragmentary view of curtain rod in accordance with one illustrative embodiment of this invention.

Referring now to the drawing for one illustrative embodiment of this invention, reference numeral 1 indicates a curtain rod with a main bar 2, a return leg 3, a web 4, an upper flange 5 and a lower flange 6.

Figure 3:
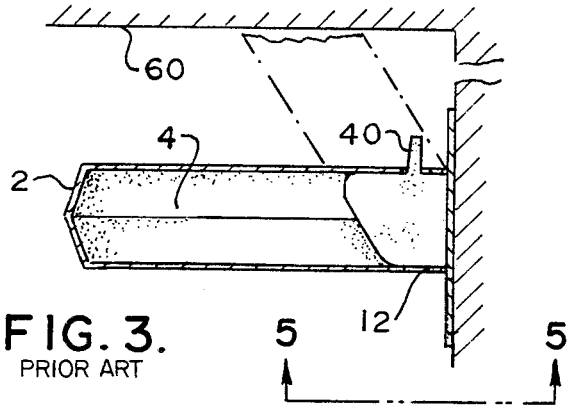
FIG. 3. PRIOR ART
FIG. 3 is a sectional view taken along the line 3—3 of FIG. 1.
Figure 5:
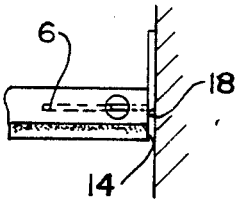
FIG. 5. PRIOR ART
FIG. 5 is a fragmentary view in bottom plan in the direction shown by line 5—5 of FIG. 3.
Figure 6:
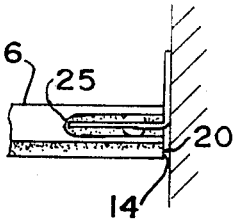
FIG. 6 is a fragmentary view in bottom plan in the direction shown by line 6—6 of FIG. 4.

In conventional curtain rods of this type, as illustrated in FIGS. 1, 3 and 5, the upper flange 5 has in it an isolated hanger finger-receiving hole 10 and a lower isolated hanger finger-receiving hole 12, both spaced from a free edge 14 of the web. The upper flange 5 in both the conventional rod and the rod of this invention has a free edge coterminous with the free edge 14 of the web 16. In the conventional rod, the lower flange also has a free edge 18 coterminous with the free edge 14. In the rod of this invention, a free edge 20 of the lower flange 6 is interrupted by a slot 25 which opens through the outer edge 20 and extends away from that edge, parallel to the web, a distance at least equal to the projecting depth of a gusset plate of a hanger bracket upon which the rod is to be mounted. The free edge of the lower flange thus has at least a portion offset from the free edge of the web.

The hanger bracket for which the rod of this invention is designed is of the type illustrated in the drawing, with a mounting foot 30, a gusset plate 32, and an upwardly projecting finger 40. The gusset plate 32 is integral at one edge with the foot 30, and at a free edge has a cam face 34 made up of a vertical edge part 35, and an inwardly downwardly sloping part 36. The gusset plate 32 also has a horizontal upper surface 37 from which the upwardly projecting finger 40 extends. The finger 40 is spaced from the foot 30 a distance sufficient to accommodate the end of the flange 5 between the hole 10 and the edge 16 of the rod.

In the conventional rod, the lower hole 12 serves no particular function except to permit the rod to be turned end for end.

Figure 4:
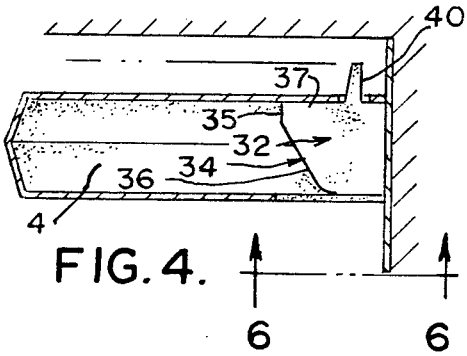
FIG. 4 is a sectional view taken along the line 4—4 of FIG. 2.

In the rod of this invention, it is only necessary to raise the flange 5 above the upper end of the finger 40 by the thickness of the flange 5, to move the rod toward the foot 30 of the bracket until the hole 10 is immediately above the finger 40, and let the rod drop. Accordingly, instead of requiring a space between the hanger bracket and a ceiling 60 sufficient to permit the main bar 2 of the rod to be raised to a position shown in dotted lines in FIG. 3 in order to install the rod, the finger of the hanger bracket in the present invention can be positioned even more closely to the ceiling than is shown in FIG. 4.

The free edge 14 of the web 4, reinforced by the portions of the edge 20 of the lower flange 6 coterminous with the web edge, supports the rod by its abutment against the wall.

Numerous variations within the scope of the appended claims will occur to those skilled in the art in the light of the foregoing disclosure. Merely by way of example, the lower flange 6 can be cut completely away, although the support of the rod is lessened.

Having thus described the invention, what is claimed and desired to be secured by letters patent is:

1. In a return type curtain rod for use with a hanger having a gusset plate and an upwardly projecting finger, said rod having a web and upper and lower flanges projecting in facing relation from opposite long edges of said web and an isolated hanger finger-receiving hole in the upper of said flanges, the improvement comprising a free end edge on said web beyond said hanger finger-receiving hole extending generally perpendicularly to the upper flange and an edge of said lower flange spaced from the said free end edge of said web in a direction short of said free end edge and clear of obstruction between said lower flange edge and said free end edge a distance to accommodate said gusset plate, whereby the free edge of said web serves to support said rod against turning moment around said finger.

* * * * *